United States Patent [19]

Power

[11] 4,285,144

[45] Aug. 25, 1981

[54] INNER SOLE FOR FOOT WEAR

[76] Inventor: Roy J. Power, 2125 Ivy Square, No. 8, Charlottesville, Va. 22901

[21] Appl. No.: 934,017

[22] Filed: Aug. 16, 1978

[51] Int. Cl.[3] ..... A43B 13/40

[52] U.S. Cl. ..... 36/44; 128/581; 128/595; 428/310; 428/315

[58] Field of Search ..... 36/44, 43, 71; 128/581, 128/595; 428/305, 310, 311, 315

[56] References Cited

U.S. PATENT DOCUMENTS

| | | | |
|---|---|---|---|
| Re. 29,501 | 12/1977 | Lapidus | 36/44 |
| 2,626,886 | 1/1953 | Scholl | 36/44 X |
| 3,109,245 | 11/1963 | Glynn | 36/44 X |
| 3,449,844 | 6/1969 | Spence | 36/44 |
| 3,457,659 | 7/1969 | Coleman | 36/44 |
| 3,489,594 | 1/1970 | Turkewitsch et al. | 428/311 |
| 3,530,489 | 9/1970 | Appleton | 36/44 |
| 3,730,169 | 5/1973 | Fiber | 36/44 X |
| 4,167,824 | 9/1979 | Wolpa | 36/44 |

*Primary Examiner*—James Kee Chi

*Attorney, Agent, or Firm*—Fidelman, Wolffe & Waldron

[57] ABSTRACT

A protective inner sole having a laminated, two layer foam construction is provided. The lower or base layer comprises an elastomeric foam having high resilience and elasticity and the top or face layer is less resilient and less elastic. The thickness of the base layer is substantially greater than that of the face layer.

5 Claims, 2 Drawing Figures

INNER SOLE FOR FOOT WEAR

BACKGROUND OF THE INVENTION

This invention relates to protective inner soles for foot wear. More specifically, this invention relates to a cushion inner sole providing a substantially increased degree of comfort and protection against foot injury during strenuous running and jumping.

One of the chronic problems faced by athletes and others who engage in strenuous or persistent running, jumping or walking is the development of blisters and bruises on the soles of the feet. The cause of blistering is often the frictional sliding of the foot surface within the shoe across the surface of the inner sole. Blistering most often occurs at those points on the foot where maximum force or pressure is applied during abrupt changes of direction. These points are most commonly under the metatarsal head and under the great toe.

A standard approach to overcoming these problems is in the provision of a pad or liner within the shoe generally referred to as an inner sole. A wide variety of materials and combinations of materials have been proposed and used in the construction of inner soles. Probably the most successful and widely used of such materials are the elastomeric foams. For example, U.S. Pat. No. 3,448,533 discloses an inner sole having a base ply of fiberboard or like material, a cushion ply of a foamed polymeric thermoplastic resin and a flexible cover ply which provides a foot contact surface.

Another approach to the use of elastomeric foams for inner soles is shown in the Spence patent, U.S. Pat. No. 3,449,844. This patent discloses an elastomeric foam base layer covered with a two way stretch fabric such as stretch nylon. The stretch fabric is adhesively bonded to the base ply and provides a slick surface between the inner sole and the user. While these prior art approaches to inner sole construction do provide a substantial cushioning effect which alleviates much of the problem of foot bruising, the problem of frictional blistering caused by the relative movement of the foot across the surface of the inner sole is still present.

SUMMARY OF THE INVENTION

This invention provides an inner sole construction which offers increased user comfort and protection against blistering. The inner sole is constructed of two layers of elastomeric foams laminated together. The base layer comprises a highly elastic and highly resilient elastomeric foam such as neoprene while the top or facing layer comprises an elastomeric foam having substantially less resilience and elasticity. The top layer is preferrably a foamed styrene butadiene rubber. The thickness of the base layer is substantially greater than that of the top layer and in a preferred embodiment is approximately twice as thick as the top layer.

Hence, it is an object of this invention to provide an improved inner sole for foot wear.

Another object of this invention is to provide an inner sole displaying substantially increased user comfort and protection against frictional blistering.

DETAILED DESCRIPTION OF THE INVENTION

Figure 1:
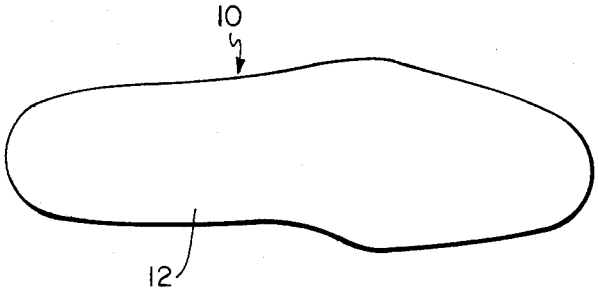
FIG. 1 is a plan view of an inner sole showing its general shape and configuration.
Figure 2:
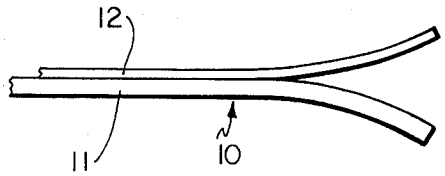
FIG. 2 is a partial sectional view of the inner sole illustrating its laminated construction.

Referring now to the drawing, the inner sole is depicted generally at 10 and comprises a base layer 11 and an upper or facing layer 12. The inner sole is cut and sized to conform generally to a foot or shoe shape and is inserted to fit snugly within a shoe. The inner sole is provided in sizes and shapes conforming generally to shoe size standards but may be cut or trimmed to conform precisely to the shoe within which it is placed.

Base layer 11 comprises a relatively thick layer of highly resilient and elastic foamed rubber such as neoprene. More specifically, base layer 11 displays a compression deflection of about 5–9 psi; a resilience as determined by the Bayshore Rebound method of approximately 50–65% and a minimum elongation of 200%. The foamed elastomer used as the base layer must also be highly resistant to permanent deformation under pressure and preferrably displays a compression set of 10–25% as determined at 50% deflection for 22 hours at room temperature with a 24 hr. recovery period at room temperature.

Top or facing layer 12 is substantially thinner than the base layer and is much less resilient and elastic. It preferrably comprises a foamed styrene butadiene copolymer rubber having a resilience as measured by the Bayshore Rebound method of between 20–30% and an elongation of at least 100%. In a most preferred embodiment, base layer 11 is approximately twice the thickness of upper layer 12 and the total thickness of the inner sole is between $\frac{1}{8}''$ and $\frac{1}{4}''$. Thickness of base layer 11 is most conveniently $\frac{1}{8}''$ and thickness of upper layer 12 is most conveniently 1/16".

In a preferred method of construction, a sheet of neoprene base stock is adhesively joined to a sheet of styrene butadiene foamed rubber to form a laminate. Inner soles of the desired size are thereafter cut from the laminate web. The adhesive used must be compatible with both materials and form a strong, permanent bond between the two. Alternatively, inner soles may be cut from each of the two materials and thereafter adhesively joined.

The properties exhibited by the composite laminate are substantially greater than either if used alone. Specifically, the neoprene base layer if used alone or with a fabric covering bottoms out or reaches an essentially incompressible state under the relatively high pressures of 20–30 psi exerted at particular points on the inner sole during active use. Provision of the upper, less compressible foam layer prevents such bottoming out and acts to distribute loads supplied by the foot more evenly and uniformly across the inner sole surface. The characteristics of the upper layer resist sliding or frictional movement of the foot relative to the surface of the inner sole and absorb these lateral movements within the laminate web. Were the styrene butadiene foam to be used as the lone component of the inner sole, it would not provide sufficient deflection or would be relatively too hard to properly absorb shock.

I claim:

1. An inner sole for foot wear which comprises a base layer and an upper layer adhesively joined to form a laminate, each of said layers comprising a foamed elastomeric rubber, said base layer having a compression deflection in the range of 5 to 9 psi, a minimum elongation of 200% and a resilience as measured by the Bayshore Rebound method of at least 50% and said upper layer having a minimum elongation of 100% and a resilience as measured by the Bayshore Rebound method of less than 30%; the resiliency and thickness of said upper layer being selected to prevent the laminate from bottoming out during use and the base layer being substantially thicker than the upper layer.

2. The inner sole of claim 1 wherein said base layer comprises a foamed neoprene rubber.

3. The inner sole of claim 2 wherein said upper layer comprises a foamed styrene butadiene rubber.

4. The inner sole of claim 1 wherein said base layer is approximately twice the thickness of said upper layer and wherein the total thickness of the inner sole is between $\frac{1}{8}$ and $\frac{1}{4}$ inch.

5. The inner sole of claim 4 wherein the base layer is approximately $\frac{1}{8}$ inch thick and wherein said upper layer is approximately 1/16 inch thick.

* * * * *